US012286735B2

(12) United States Patent
Sagerer-Foric

(10) Patent No.: US 12,286,735 B2
(45) Date of Patent: Apr. 29, 2025

(54) METHOD FOR PRODUCING SPUNBONDED FABRIC

(71) Applicant: LENZING AKTIENGESELLSCHAFT, 4860 Lenzing (AT)

(72) Inventor: Ibrahim Sagerer-Foric, 4840 Vöcklabruck (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 303 days.

(21) Appl. No.: 17/801,592

(22) PCT Filed: Feb. 24, 2021

(86) PCT No.: PCT/EP2021/054493
§ 371 (c)(1),
(2) Date: Aug. 23, 2022

(87) PCT Pub. No.: WO2021/170605
PCT Pub. Date: Sep. 2, 2021

(65) Prior Publication Data

US 2023/0130447 A1 Apr. 27, 2023

(30) Foreign Application Priority Data

Feb. 24, 2020 (EP) ..... 20159099

(51) Int. Cl.
*D04H 3/16* (2006.01)
*D01D 1/09* (2006.01)
(Continued)

(52) U.S. Cl.
CPC ..... *D04H 3/16* (2013.01); *D01D 1/09* (2013.01); *D01D 4/025* (2013.01); *D01D 4/06* (2013.01);
(Continued)

(58) Field of Classification Search
CPC ..... D01D 1/09; D01D 4/025; D01D 4/06; D01D 5/12–16
See application file for complete search history.

(56) References Cited

U.S. PATENT DOCUMENTS 3,825,380 A 7/1974 Harding et al.
4,166,001 A 8/1979 Dunning et al.
(Continued)

FOREIGN PATENT DOCUMENTS

CN 101550611 B 12/2010
CN 109989181 A 7/2019
(Continued)

*Primary Examiner* — John J DeRusso
(74) *Attorney, Agent, or Firm* — Venable LLP

(57) ABSTRACT

A process for the production of spunbonded nonwoven (1) is shown, wherein a spinning mass (2) is extruded through a plurality of nozzle holes (4) of at least one spinneret (3, 40, 50) to form filaments (5) and the filaments (5) are drawn, in each case, in the extrusion direction, wherein the filaments (5) are deposited on a perforated conveying device (10) to form a spunbonded nonwoven (1) and wherein the nozzle holes (4) of the spinneret (3, 40, 50) are arranged along a main axis (6) oriented in a transverse direction (12) to the conveying direction (11) of the conveying device (10) so that the spunbonded nonwoven (1) formed on the conveying device (10) extends in this transverse direction (12). So as to enable the spinning width and the basis weight distribution of the spunbonded nonwoven to be adjusted reliably and, respectively, to allow the basis weight distribution to be kept constant during operation by means of the process, it is suggested that the spinning mass throughput (31) of the nozzle holes (4) is adjusted variably along the transverse direction (12).

26 Claims, 4 Drawing Sheets

(51) Int. Cl.

| | |
|---|---|
| ***D01D 4/02*** | (2006.01) |
| ***D01D 4/06*** | (2006.01) |
| ***D01D 5/098*** | (2006.01) |
| ***D01D 5/14*** | (2006.01) |
| ***D01D 7/00*** | (2006.01) |
| ***D04H 3/013*** | (2012.01) |
| ***D04H 3/03*** | (2012.01) |
| ***D06H 7/04*** | (2006.01) |

(52) U.S. Cl.
CPC ..... *D01D 5/0985* (2013.01); *D01D 5/14* (2013.01); *D01D 7/00* (2013.01); *D04H 3/013* (2013.01); *D04H 3/03* (2013.01); *D06H 7/04* (2013.01); *D10B 2201/22* (2013.01)

(56) References Cited

U.S. PATENT DOCUMENTS

| | | | | |
|---|---|---|---|---|
| 4,380,570 | A | | 4/1983 | Schwarz |
| 4,434,204 | A | | 2/1984 | Hartman et al. |
| 4,523,350 | A | | 6/1985 | Schmiedgen et al. |
| 4,755,421 | A | | 7/1988 | Manning et al. |
| 5,080,569 | A | | 1/1992 | Gubernick et al. |
| 5,284,703 | A | | 2/1994 | Everhart et al. |
| 5,361,466 | A | | 11/1994 | Robertson et al. |
| 5,487,655 | A | * | 1/1996 | Frey ..... D01D 5/0985 425/141 |
| 5,587,225 | A | | 12/1996 | Griesbach et al. |
| 5,695,377 | A | | 12/1997 | Triebes et al. |
| 5,728,407 | A | * | 3/1998 | Matsui ..... D04H 3/16 425/464 |
| 6,306,334 | B1 | | 10/2001 | Luo et al. |
| 6,358,461 | B1 | | 3/2002 | Law et al. |
| 6,861,025 | B2 | | 3/2005 | Erickson et al. |
| 7,156,639 | B2 | | 1/2007 | Baumeister |
| 7,432,219 | B2 | | 10/2008 | Strandqvist et al. |
| 7,438,544 | B2 | | 10/2008 | Glawion et al. |
| 7,690,902 | B2 | | 4/2010 | Erickson et al. |
| 7,732,357 | B2 | | 6/2010 | Annis et al. |
| 8,082,638 | B2 | | 12/2011 | Muenstermann |
| 8,191,214 | B2 | | 6/2012 | Luo et al. |
| 8,282,877 | B2 | | 10/2012 | White et al. |
| 8,366,988 | B2 | | 2/2013 | Chou et al. |
| 9,394,637 | B2 | | 7/2016 | Knowlson et al. |
| 9,631,321 | B2 | | 4/2017 | Brennan et al. |
| 9,696,088 | B2 | | 7/2017 | Böhn et al. |
| 9,868,240 | B2 | | 1/2018 | Chou et al. |
| 9,982,367 | B2 | | 5/2018 | Goretzki et al. |
| 10,273,635 | B2 | | 4/2019 | Miller, IV et al. |
| 11,136,700 | B2 | | 10/2021 | Venema et al. |
| 2003/0234464 | A1 | | 12/2003 | Erickson et al. |
| 2004/0013859 | A1 | | 1/2004 | Annis et al. |
| 2004/0265415 | A1 | | 12/2004 | Baumeister |
| 2005/0056956 | A1 | | 3/2005 | Zhao et al. |
| 2005/0112980 | A1 | | 5/2005 | Strandqvist et al. |
| 2007/0104812 | A1 | | 5/2007 | Glawion et al. |
| 2007/0237849 | A1 | | 10/2007 | Erickson et al. |
| 2008/0006310 | A1 | | 1/2008 | Munstermann et al. |
| 2008/0197522 | A1 | | 8/2008 | Schemken et al. |
| 2009/0186189 | A1 | | 7/2009 | White et al. |
| 2009/0188090 | A1 | | 7/2009 | Muenstermann |
| 2009/0233049 | A1 | | 9/2009 | Jackson et al. |
| 2010/0162542 | A1 | | 7/2010 | Luo et al. |
| 2010/0236034 | A1 | | 9/2010 | Eagles et al. |
| 2011/0156303 | A1 | | 6/2011 | Chou et al. |
| 2011/0244199 | A1 | | 10/2011 | Brennan et al. |
| 2014/0170402 | A1 | | 6/2014 | Knowlson et al. |
| 2015/0267965 | A1 | | 9/2015 | Böhn et al. |
| 2016/0145810 | A1 | | 5/2016 | Miller, IV et al. |
| 2016/0214302 | A1 | | 7/2016 | Chou et al. |
| 2016/0312384 | A1 | | 10/2016 | Goretzki et al. |
| 2018/0168893 | A1 | | 6/2018 | Ashraf et al. |
| 2018/0282920 | A1 | | 10/2018 | Carlyle et al. |
| 2019/0226133 | A1 | | 7/2019 | Venema et al. |
| 2020/0100956 | A1 | | 4/2020 | Ashraf et al. |
| 2020/0291545 | A1 | | 9/2020 | Sagerer-Foric |
| 2021/0292949 | A1 | | 9/2021 | Sagerer-Foric |
| 2023/0250558 | A1 | | 8/2023 | Sommer et al. |

FOREIGN PATENT DOCUMENTS

| | | | |
|---|---|---|---|
| DE | 3603814 | A1 | 8/1987 |
| DE | 102009016019 | A1 | 10/2010 |
| DE | 102012109878 | A1 | 4/2014 |
| EP | 0333211 | A2 | 9/1989 |
| EP | 1445366 | A2 | 8/2004 |
| EP | 1486591 | A1 | 12/2004 |
| EP | 1567322 | B1 | 6/2009 |
| EP | 2041344 | B1 | 9/2009 |
| EP | 1873290 | B1 | 7/2013 |
| EP | 2462269 | B1 | 10/2013 |
| EP | 1616052 | B1 | 6/2016 |
| EP | 3088585 | A1 | 11/2016 |
| EP | 3254655 | A1 | 12/2017 |
| GB | 1474102 | A | 5/1977 |
| GB | 2114052 | A | 8/1983 |
| WO | 2012090130 | A2 | 7/2012 |
| WO | 2015000687 | A1 | 1/2015 |
| WO | 2018071928 | A1 | 4/2018 |
| WO | 2018184046 | A1 | 10/2018 |
| WO | 2018184048 | A1 | 10/2018 |
| WO | 2019068764 | A1 | 4/2019 |
| WO | 2020016296 | A1 | 1/2020 |

* cited by examiner

METHOD FOR PRODUCING SPUNBONDED FABRIC

CROSS REFERENCE TO RELATED APPLICATIONS

The present application is a national-stage entry under 35 U.S.C. § 371 of International Patent Application No. PCT/EP2021/054493, published as WO 2021/170605 A1, filed Feb. 24, 2021, which claims priority to EP 20159099.9, filed Feb. 24, 2020, the entire disclosure of each of which is hereby incorporated by reference.

BACKGROUND OF THE INVENTION

Field of the Invention

The present invention relates to a process for the production of spunbonded nonwoven, wherein a spinning mass is extruded through a plurality of nozzle holes of at least one spinneret to form filaments and the filaments are drawn, in each case, in the extrusion direction, wherein the filaments are deposited on a perforated conveying device to form a spunbonded nonwoven and wherein the nozzle holes of the spinneret are arranged along a main axis oriented in a transverse direction to the conveying direction of the conveying device so that the spunbonded nonwoven formed on the conveying device extends in this transverse direction.

Prior Art

The production of spunbonded nonwovens and, respectively, nonwoven fabrics by the spunbond process, on the one hand, and by the meltblown process, on the other hand, is known from the prior art. In the spunbond process (e.g., GB 2 114 052 A or EP 3 088 585 A1), the filaments are extruded through a nozzle and pulled off and drawn by a drawing unit located underneath. By contrast, in the meltblown process (e.g., U.S. Pat. Nos. 5,080,569 A, 4,380,570 A or 5,695,377 A), the extruded filaments are entrained and drawn by hot, fast process air as soon as they exit the nozzle. In both technologies, the filaments are deposited in a random orientation on a deposit surface, for example, a perforated conveyor belt, to form a nonwoven fabric, are carried to post-processing steps and finally wound up as nonwoven rolls.

Devices for the production of spunbonded nonwovens are normally designed for a certain product width or, respectively, spinning width. All system components are also designed for this product width. In the course of the production of spunbonded nonwovens, for example, for the hygiene sector, the nonwoven web is usually cut across its width into a plurality of narrow strips. The design happens in advance in such a way that the smallest possible edge cut is created. For various technical applications, larger amounts of waste might arise depending on the number and width of the strips to be cut. In order to avoid large amounts of waste, it is useful to reduce the spinning width.

In CN 101550611 B, a modular sequence of spinnerets for the production of spunbonded nonwoven is described, wherein each nozzle module has its own supply line for the melt. In this way, the entire spinning width can be reduced or enlarged at least in accordance with the width of a module by switching on or deactivating the respective spinning pump of the module. However, as mentioned, for example, in EP 1 486 591 A1, the practical application shows that the shutdown of modules has the effect that the melt in the respective module gets thermally damaged, the nozzle holes are clogged by the damaged melt and the switching on as well as the deactivation of the modules will be problematic in everyday production.

Based on EP 1 486 591 A1, the spinning width can be changed by means of distribution plates and subsequent shorter or longer extrusion plates. However, this can be accomplished only by removing the spinneret, rather than during operation. The downtime for replacing the plates and spinnerets and the expenditure on mechanical engineering have a negative impact on the economic efficiency of such systems.

In U.S. Pat. No. 7,438,544, a device for adjusting the spinning widths in meltblown spinnerets is described, wherein the melt and the primary air can be switched on and off in a modular fashion. Shutoff devices are used for this purpose, and the melt is thereby prevented from flowing further. However, also in this variant, a decrease in the quality of the melt occurs disadvantageously, as it is enclosed at high temperatures for an extended period of time. Experience has shown that a thermal decomposition occurs in such places, and both the melt and the distributor block as well as the spinneret material will suffer as a result. Furthermore, the extrusion holes will be clogged, and a new spinning start for the previously stopped modules will be problematic. Especially in the production of cellulosic spunbonded nonwoven, e.g., with a lyocell spinning mass, long dwell times or even a standstill of the spinning mass should be avoided, since, otherwise, the spinning mass might react exothermically.

It is also known from the prior art to produce cellulosic spunbonded nonwovens according to the spunbond technology (e.g., U.S. Pat. No. 8,366,988 A) and according to the meltblown technology (e.g., U.S. Pat. Nos. 6,358,461 A and 6,306,334 A). A lyocell spinning mass is thereby extruded and drawn in accordance with the known spundbond or meltblown processes, however, prior to the deposition into a nonwoven, the filaments are additionally brought into contact with a coagulant in order to regenerate the cellulose and produce dimensionally stable filaments. The wet filaments are finally deposited in a random orientation as a nonwoven fabric.

Since the spinning masses that are used have pulp contents of 3 to 17%, a larger amount of spinning mass is required in cellulosic spunbond technologies than in the production of thermoplastic spunbonded nonwovens for achieving the same productivity. The result is that, in comparison to thermoplastic spunbond plants, larger spinning pumps, pipelines, distributor blocks and primary air lines have to be used, with the productivity being identical. A modular design, as described, for example, in CN 101550611 B and already known from other publications, might indeed be used, but would involve extremely high costs for the spinning pumps, the spinning mass pipelines, the distributor blocks, the primary air line and the spinnerets. In addition, a thermal decomposition and exothermic reaction of the lyocell spinning mass cannot be reliably prevented in the module that has been switched off.

In the prior art as mentioned, the question remains open as to how one of the main characteristics of a nonwoven fabric, the basis weight, can be adjusted uniformly even after the spinning width has been changed. The distribution of melt across multiple modules, as described in CN 101550611 B, has the effect that more melt has to be conveyed through the remaining modules, if one module is switched off, for example. Also, in EP 1 486 591 and in U.S. Pat. No. 7,438,544, the question arises as to how the mass flow of the melt can be evenly distributed across the remaining spinning width and how this affects the basis weight and the basis weight distribution of the spunbonded nonwoven. In particular in case of a cellulosic spinning mass according to the lyocell process, it has been shown that, even with a constant spinning mass flow, a homogeneous distribution of the cellulose content in the spinning mass across the entire spinning width can hardly be achieved. As a drawback, this also inevitably leads to a non-constant basis weight of the product, and a possible adjustment of the basis weight is also significantly more difficult than, for example, for thermoplastic spunbonded nonwovens.

Especially for the production of cellulosic spunbonded nonwoven, the prior art thus fails to offer a reliable solution for adjusting the spinning width of the spunbonded nonwoven during operation and, at the same time, for keeping the basis weight of the spunbonded nonwoven constant in the event of fluctuations in the spinning mass.

SUMMARY OF THE INVENTION

Therefore, it is the object of the present invention to provide a process of the initially mentioned type, which enables the spinning width and the basis weight distribution of the spunbonded nonwoven to be adjusted reliably and, respectively, allows the basis weight distribution to be kept constant during operation.

The invention achieves the object that is posed in that the spinning mass throughput of the nozzle holes is adjusted variably along the transverse direction.

It has become apparent that, by variably adjusting the spinning mass throughput of the nozzle holes along the transverse direction, any desired basis weight distribution of the spunbonded nonwoven can be adjusted across the entire width of the spinneret along its main axis. Such an arbitrary basis weight distribution enables the production of a spunbonded nonwoven with several advantageous aspects, as will be illustrated below. On the one hand, the basis weight distribution of the spunbonded nonwoven can be kept equally constant across its entire width by changing and adapting the spinning mass throughput, and, thus, it becomes possible to reliably respond to fluctuations in the spinning mass or in the permeability of the spinnerets, thereby improving the quality of the spunbonded nonwoven. On the other hand, by variably adjusting the spinning mass throughput along the transverse direction of the spunbonded nonwoven, several areas with different basis weights can be created, whereby a very versatile spunbonded nonwoven can be created for a large number of possible applications.

For example, a spunbonded nonwoven can thus be created which, in the transverse direction, has several parallel thicker strips with high basis weights and intermediate thinner strips with lower basis weights. Alternatively, for example, a spunbonded nonwoven with a thickness starting from the edge and increasing uniformly in the transverse direction can also be created. Of course, a spunbonded nonwoven which implements several of the above-described aspects can also be created with the process according to the invention. A versatile and reliable process for the production of a spunbonded nonwoven with an adjustable basis weight distribution can thus be provided.

In particular in the production of cellulosic spunbonded nonwovens, the process according to the invention gives rise to numerous improvements and advantages in terms of the economic efficiency and the operation of the production process as well as the product quality of the spunbonded nonwoven. Both the costs and the complexity of the plants for performing the process can thereby be reduced significantly. In particular, in such a plant, it is not necessary to resort to the complex and error-prone use of numerous small interlocked spinneret modules with a plurality of associated spinning mass pumps in order to adjust the basis weight distribution of the cellulosic spunbonded nonwoven. Through the use of spinnerets, which allow the spinning mass throughput to be changed in the transverse direction, structurally simple and inexpensive processes for the production of the spunbonded nonwoven can be provided.

Furthermore, if the temperature distribution in the spinneret is changed, the variable spinning mass throughput of the nozzle holes can be controlled reliably and easily in terms of process engineering. Surprisingly, it has been shown that, by specifically cooling and/or heating areas of the spinneret, their spinning mass throughput can be specifically reduced or, respectively, increased in the cooled or heated areas without negatively affecting the stability and correctness of the spinning operation, the deposition of the spunbonded nonwoven or the quality of the spinning mass.

The production of cellulosic spunbonded nonwovens from a lyocell spinning mass takes place at relatively low temperatures of around 100° C., compared to thermoplastic melts. In this connection, it has become apparent that even small temperature changes within the spinneret are sufficient to increase or, respectively, decrease the viscosity at the cooled or heated spot, allowing less or, respectively, more spinning mass to flow out. Surprisingly, a continuous flow of spinning mass through the nozzle holes of the spinneret can still be maintained in this case so that an increased occurrence of spinning defects is avoided and a finished spunbonded nonwoven of high quality can be obtained.

The circumstance outlined above is particularly surprising, since, in conventional melt spinning processes according to the prior art, for example, for the production of polyethylene terephthalate or polyamide nonwovens, a reduction in the temperature in part of a spinneret, with otherwise consistent operating conditions, inevitably causes the affected nozzle holes to be grown shut or, respectively, clogged, thus leading to disastrous spinning defects to the point of failure of the entire spinneret.

The reliability of the process can be improved further if the pressure distribution of the spinning mass in the spinneret is changed in order to control the spinning mass throughput of the nozzle holes, which is variable in the transverse direction. Thus, in addition to varying the temperature distribution in the spinneret, there is also the possibility of varying the pressure of the spinning mass in the transverse direction of the spinneret, thus adjusting a desired pressure distribution. Hence, the process is able to reliably control the spinning mass throughput in a variety of different situations as a function of several parameters.

If several spinning mass pumps are allocated to the spinneret along the transverse direction in order to adjust the pressure of the spinning mass in the spinneret, a variable pressure distribution along the transverse direction can be adjusted easily in terms of process engineering.

The above-mentioned advantages can be improved further if the spinneret is designed in multiple parts in the transverse direction, with at least one spinning mass pump being allocated to each part of the spinneret.

If the spunbonded nonwoven has at least one edge cut area of a lower basis weight, the economic efficiency of the process can be further improved. In this case, the process according to the invention especially allows an amount of edge cuts to be minimized, with the spinning width of the spunbonded nonwoven remaining the same, for example, if a spunbonded nonwoven of a smaller width is to be produced.

In order to produce spunbonded nonwovens of a smaller width, the finished spunbonded nonwoven web, which has the same basis weight across its entire width, is usually cut to the desired width in processes according to the prior art, whereby a high amount of waste accumulates and the yield of the process is thus reduced. This can be avoided especially in that the basis weight in the edge cut area is lower or significantly reduced in comparison to the basis weight of the rest of the spunbonded nonwoven so that only insignificant amounts will accumulate as waste. In addition, the production rate for the spunbonded nonwoven can be increased with the spinning mass throughput remaining the same, whereby the economic efficiency of the process can be further improved.

Moreover, in the process according to the invention, the reduction in the basis weight within the edge cut area can be accomplished during operation without the need to replace spinnerets, spinneret parts, spinning mass pumps or spinning mass distributors. In particular, shutoff devices, which create dead spaces and which, in case of cellulosic spunbonded nonwovens, may lead to thermal degradation of the spinning mass and possibly to exothermic reactions, do not have to be installed in this case.

According to the invention, it has been shown in this case that the reduction of the waste in the edge cut area can be controlled with the aid of a temperature profile in such a way that the basis weight of the edge cut can be radically reduced and, as a result, maybe not the edge cut width, but indeed the edge cut amount is significantly reduced over time.

The basis weight of the spunbonded nonwoven in the edge cut area can preferably be reduced by at least 80%, particularly preferably by at least 90%, in comparison to the basis weight of the spunbonded nonwoven in the useful area.

The above-mentioned advantages come into effect especially if the basis weight of the spunbonded nonwoven in the edge cut area is less than or equal to 5 g/m2. In particular the reliability of the process can thus be further improved, since a constant spinning mass flow through the spinnerets can be maintained despite the greatly reduced basis weight in the edge cut area.

In one example, a spunbonded nonwoven of a total width of 300 cm is to be adjusted to a useful area of 260 cm. In doing so, the basis weight in the edge cut area can be reduced to below 5 g/m$^2$ across a width of 40 cm, with the basis weight of the spunbonded nonwoven amounting to 50 g/m$^2$ in the useful area. Without the process according to the invention, a strip of a width of 40 cm with 50 g/m$^2$ as edge cut would accrue in the edge cut area. By means of the process according to the invention, the amount of edge cuts can be reduced by 90% from 50 g/m$^2$ to 5 g/m$^2$ in this example.

It has become apparent that the adjustment of the basis weight distribution for minimizing the edge cut accumulating as waste, in particular for the production of cellulosic spunbonded nonwovens, can be done both faster and more accurately according to the invention than with a spinneret of a merely modular construction (in which modules can be switched on and deactivated). In addition, the productivity of the plant can also be increased with the solution according to the invention.

Moreover, with the process according to the invention, it is possible to produce the cellulosic spunbonded nonwoven fabrics with 5 g/m$^3$ to 1000 g/m$^2$, preferably with 10 g/m$^2$ to 500 g/m$^2$, particularly preferably with 15 g/m$^2$ to 250 g/m$^2$, and to adjust and regulate the basis weight distribution. In this case, the basis weight of the edge cut areas can be reduced as far as to 5 g/m$^2$, and the proportion of edge cut areas may account for between 1% and 50%, preferably between 2% and 30%, particularly preferably between 3% and 20%, of the spinning width of the spinnerets.

The reliability of the process can be improved further if the actual basis weight distribution of the spunbonded nonwoven is measured, the difference between the actual basis weight distribution and a predefined target basis weight distribution is determined and the spinning mass throughput of the nozzle holes in the transverse direction is variably adjusted as a function of the determined difference.

If the actual basis weight distribution of the spunbonded nonwoven is measured, the adjustment according to the invention of the spinning mass throughput in the transverse direction of the spinneret can subsequently be used in order to adapt the actual basis weight distribution of a predetermined target basis weight distribution in the nonwoven fabric and also to keep it constant by means of the process according to the invention. For this purpose, the actual basis weight distribution of the spunbonded nonwoven is continuously determined and compared to a (temporally variable) target basis weight distribution. The spinning mass throughput of the nozzle holes is then adjusted or, respectively, adapted as a function of the difference between the measured actual basis weight distribution and the predetermined target basis weight distribution. This can be done, for example, as explained above, by changing the temperature of the spinneret or by changing the spinning mass pressure.

In addition, the conveying speed of the conveying device can be adjusted as a function of the difference between the actual basis weight distribution and the predefined target basis weight distribution. This is of particular advantage, for example, if the basis weight of the spunbonded nonwoven is to be increased or reduced without changing the spinning mass throughput. In this way, for example, also the production rate can be adapted to the spinning mass throughput.

In doing so, the actual basis weight distribution of the spunbonded nonwoven can advantageously be measured by means of a detection device. Such a detection device can be composed, for example, of a number of cameras, optical sensors (e.g., lasers), mechanical sensors and/or sensors for non-contact and non-destructive measurement (e.g., ultrasonic sensors).

In addition, by means of a control unit connected to the detection device, the difference between the actual basis weight distribution measured by the detection device and the target basis weight distribution stored in the control unit can be determined. Depending on the determined difference, the control unit can then output at least one control signal for changing the variable spinning mass throughput of the nozzle holes to a spinning mass control device regulating the temperature distribution and/or the pressure distribution of the spinnerets. The process can thus be equipped with an automatic control system, which enables a reproducible and exact regulation of the basis weight distribution of the spunbonded nonwoven.

In addition, depending on the determined difference, the control unit can output at least one control signal for changing the conveying speed of the conveyor belt to a conveyor belt control device. In addition to the basis weight distribution, the throughput of the process can also be varied, and all parameters of the production process can thus be regulated automatically.

Since the basis weight distribution is measured continuously during operation, it is an advantage of the process according to the invention that the slightest fluctuations can be detected and compensated for by means of the control unit. A spunbonded nonwoven according to the invention, in particular a cellulosic spunbonded nonwoven, with a coefficient of variation of the basis weight of 0% to 3%, preferably of 0% to 2%, particularly preferably of 0% to 0.5%, measured according to the standard "Determination of grammage (ISO 9073-1: 1989)", can thereby be produced.

A basis weight as constant as possible provides advantages for the further processing. If, for example, products with lotions, e.g., moist wipes, wiping cloths, cleaning tissues or facial sheet masks, are to be produced from the cellulosic spunbonded nonwoven fabric, both the application of the lotion and the distribution of the lotion in the later product will not only be easier during production, but will also be visually and haptically identifiable for the end customer. A uniform basis weight is a clear and measurable quality feature for nonwoven fabrics, which can be reliably achieved by means of the process according to the invention.

The above-described advantages of the process according to the invention come into effect especially in the production of cellulosic spunbonded nonwovens, with the spinning mass being a lyocell spinning mass, i.e., a solution of cellulose in a direct solvent for cellulose.

It has been shown that, in contrast to thermoplastic melts, in which the spinning mass pumps are operated at a constant rate, the speed of the spinning mass pumps has to be adapted continuously in the production of cellulosic spunbonded nonwoven for regulating the basis weight and the basis weight distribution, since the cellulose content in the spinning mass varies permanently. Furthermore, it has been shown that the temperature of the spinning mass varies across the spinning width and that this variation, which would lead to a differing spinning mass throughput along the transverse direction of the spinneret, can be compensated for, for example, by means of a specific adjustment of the temperature distribution. It has been shown that also the conveying speed of the perforated conveying device has to be adapted permanently because of the fluctuation in the cellulose content in the spinning mass in order to keep the basis weight roughly constant over time. With the process according to the invention, such a variation in the cellulose content can be reliably compensated for by specifically adapting the spinning mass throughput via the temperature and pressure profile.

A direct solvent for cellulose is understood to be a solvent in which the cellulose is present in a dissolved state in a non-derivatized form. This can preferably be a mixture of a tertiary amine oxide, such as NMMO (N-methylmorpholine-N-oxide), and water. Alternatively, however, ionic liquids or, respectively, mixtures with water are, for example, also suitable as direct solvents.

The cellulose throughput per spunbond nozzle may range from 5 kg/h/m nozzle width to 500 kg/h/m nozzle width.

In this case, the cellulose content in the spinning mass can be between 3% by weight and 17% by weight, preferably between 5% by weight and 15% by weight, particularly preferably between 6% by weight and 14% by weight.

The temperature of the spinning mass prior to the entry into the spinneret can be between 60° C. and 160° C., preferably between 80° C. and 140° C., particularly preferably between 100° C. and 120° C.

The temperature profile of the spinneret can be adjusted such that the temperature of the spinning mass during the exit from the nozzle holes ranges between 60° C. and 160° C., preferably between 80° C. and 140° C., particularly preferably between 100° C. and 120° C.

The temperature of the drawing air stream can be between 20° C. and 200° C., preferably between 60° C. and 160° C., particularly preferably between 80° C. and 140° C.

The air pressure of the drawing air stream can range from 0.05 bar to 5 bar, preferably from 0.1 bar to 3 bar, particularly preferably from 0.2 bar to 1 bar.

In addition, the internal structure of the spunbonded nonwoven can be reliably controlled if the filaments that have been extruded from the spinneret and drawn are partially coagulated.

For this purpose, a coagulation air stream comprising a coagulation liquid can be allocated to the spinneret for an at least partial coagulation of the filaments, whereby the internal structure of the spunbonded nonwoven can be controlled specifically. In this case, a coagulation air stream can preferably be a fluid containing water and/or a fluid containing coagulant, for example, gas, mist, vapour, etc.

If NMMO is used as a direct solvent in the lyocell spinning mass, the coagulation liquid may be a mixture of demineralized water and 0% by weight to 40% by weight of NMMO, preferably 10% by weight to 30% by weight of NMMO, particularly preferably 15% by weight to 25% by weight of NMMO. A particularly reliable coagulation of the extruded filaments can thereby be achieved.

The spunbonded nonwoven according to the process according to the invention may also consist of several spunbonded nonwoven layers, wherein the basis weights and properties can be different for each layer. For example, in the development of new gas and liquid filters, the combination of several spunbonded nonwoven layers with different basis weights and/or air permeabilities can be used for the manufacture of high-performance filters.

In one embodiment variant, those individual spunbonded nonwoven layers can be produced simultaneously by spinnerets positioned one behind the other and can be deposited on top of each other in such a way that a multi-layered spunbonded nonwoven is formed. Subsequently, the spunbonded nonwoven layers are connected by hydroentanglement. It has been shown that hydroentanglement and drying may indeed affect the basis weight due to a certain shrinkage of the spunbonded nonwoven, but this effect can be offset by the process according to the invention. For example, when a threshold value of the basis weight is exceeded after drying, this can be compensated for by the regulation according to the invention in that the spinning mass throughput of the individual spunbonded nonwoven layers deposited on top of each other is adapted.

The multiple spinnerets for producing the multi-layered spunbonded nonwoven can be successively connected in series in the production direction, with at least one coagulation device being allocated to each spinneret.

The spinnerets used according to the invention can be single-row slit nozzles, multi-row needle nozzles, or preferably column nozzles of a width of, in particular, between 0.1 m and 6 m, as known from the prior art (U.S. Pat. Nos. 3,825,380, 4,380,570, WO 2019/068764).

According to the invention, the spinnerets may consist of several spinneret modules. In this case, at least one spinning pump is preferably provided for each spinneret or, respectively, for each spinneret module.

In this connection, it is furthermore preferred that, for each spinneret and/or for each spinneret module, at least one spinneret control device is provided, which controls the temperature distribution in the spinneret or, respectively, in the spinneret module. Depending on the desired accuracy of the control of the temperature distribution, a different number of spinneret control devices may be provided.

The adjustment and regulation of the temperature of the spinnerets, or, subsequently, of the temperature distribution, may take place, for example, by means of infrared, ultrasound, electrically, with vapour, oil or other fluids or technologies for heat transmission that are known to a person skilled in the art.

For example, basis weight measuring devices of the type Qualiscan QMS-12 from the manufacturer Mahlo GmbH & Co. KG, Saal an der Donau, Germany, might be suitable as detection devices for detecting the basis weight distribution of the spunbonded nonwoven.

BRIEF DESCRIPTION OF THE FIGURES

In the following, preferred embodiment variants of the invention are illustrated in further detail with reference to the drawings.

DETAILED DESCRIPTION OF THE INVENTION

Figure 1:
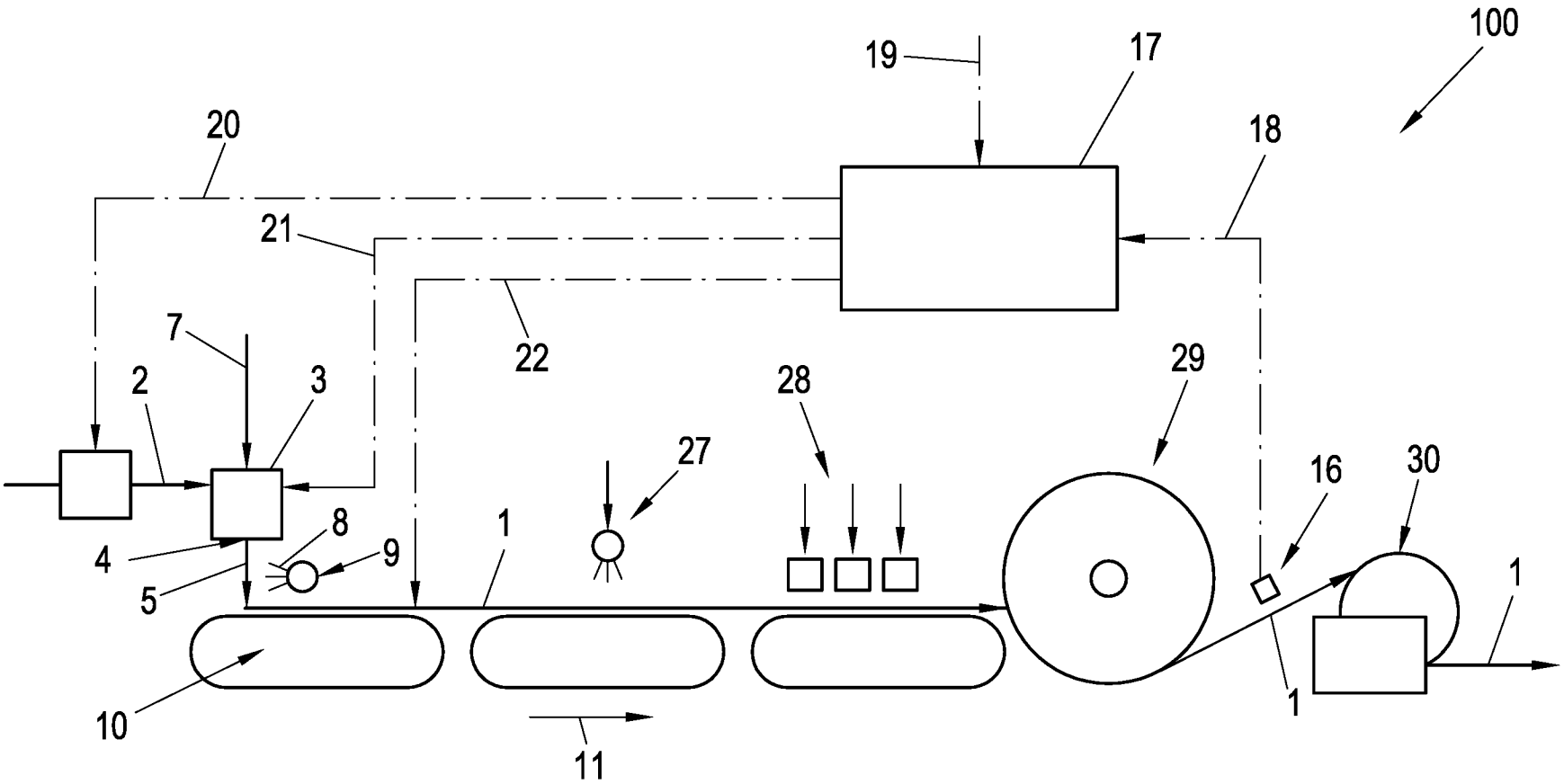
FIG. 1 shows a schematic illustration of the process according to the invention as per a first embodiment variant.

FIG. 1 shows a schematic illustration of a process 100 for the production of cellulosic spunbonded nonwoven 1 according to a first embodiment variant of the invention. In a first process step, a spinning mass 2 is produced from a cellulosic raw material and supplied to a spinneret 3. In this case, the cellulosic raw material for producing the spinning mass 2, which production is not shown in further detail in the figures, can be a pulp made of wood or other plant-based starting materials, which is suitable for the production of lyocell filaments. However, it is also conceivable that the cellulosic raw material consists at least partly of production waste from the production of spunbonded nonwoven or recycled textiles. In this case, the spinning mass 2 is a solution of cellulose in NMMO and water, with the cellulose content in the spinning mass ranging between 3% by weight and 17% by weight.

In a following step, the spinning mass 2 is then extruded through a plurality of nozzle holes 4 in the spinneret 3 to form filaments 5, with the nozzle holes 4 in the spinneret 3 being arranged along a main axis 6. In this case, the main axis 6 of the spinneret 3 is aligned along a transverse direction 12 to the conveying direction 11 of the spunbonded nonwoven, which is shown in detail in particular in the schematic illustration of the process 100 in FIG. 2. In this case, the spinning mass throughput of the nozzle holes 4 along the transverse direction 12 is variably adjusted in the spinneret 3 so that the individual nozzle holes 4 have a differing spinning mass output in the transverse direction 12.

The extruded filaments 5 are then accelerated and drawn by a drawing air stream. For generating the drawing air stream, a drawing device is provided in the spinneret 3, which device is supplied with drawing air 7 and ensures that the drawing air stream exits the spinneret 3 in order to accelerate the filaments 5 after their extrusion.

In one embodiment variant, the drawing air stream can emerge between the nozzle holes of the spinneret 3. In a further embodiment variant, the drawing air stream may alternatively emerge around the nozzle holes. However, this is not illustrated in further detail in the figures. Such spinnerets 3 comprising drawing devices for generating a drawing air stream are known from the prior art (U.S. Pat. Nos. 3,825,380 A, 4,380,570 A, WO 2019/068764 A1).

Moreover, the extruded and drawn filaments 5 are charged with a coagulation air stream 8, which is provided by a coagulation device 9. The coagulation air stream 8 usually comprises a coagulation liquid, for example, in the form of vapour, mist, etc. Due to the contact of the filaments 5 with the coagulation air stream 8 and the coagulation liquid contained therein, the filaments 5 are coagulated at least partly, which, in particular, reduces adhesions between the individual extruded filaments 5.

The drawn and at least partially coagulated filaments 5 are then deposited in a random orientation on a conveyor belt 10 as a conveying device 10, forming the spunbonded nonwoven 1 there. The conveyor belt 10 then carries the formed spunbonded nonwoven 1 away in the conveying direction 11, with the spunbonded nonwoven 1 formed on the conveyor belt 10 extending on the conveyor belt 10 in the transverse direction 12 to the conveying direction 11.

Figure 2:
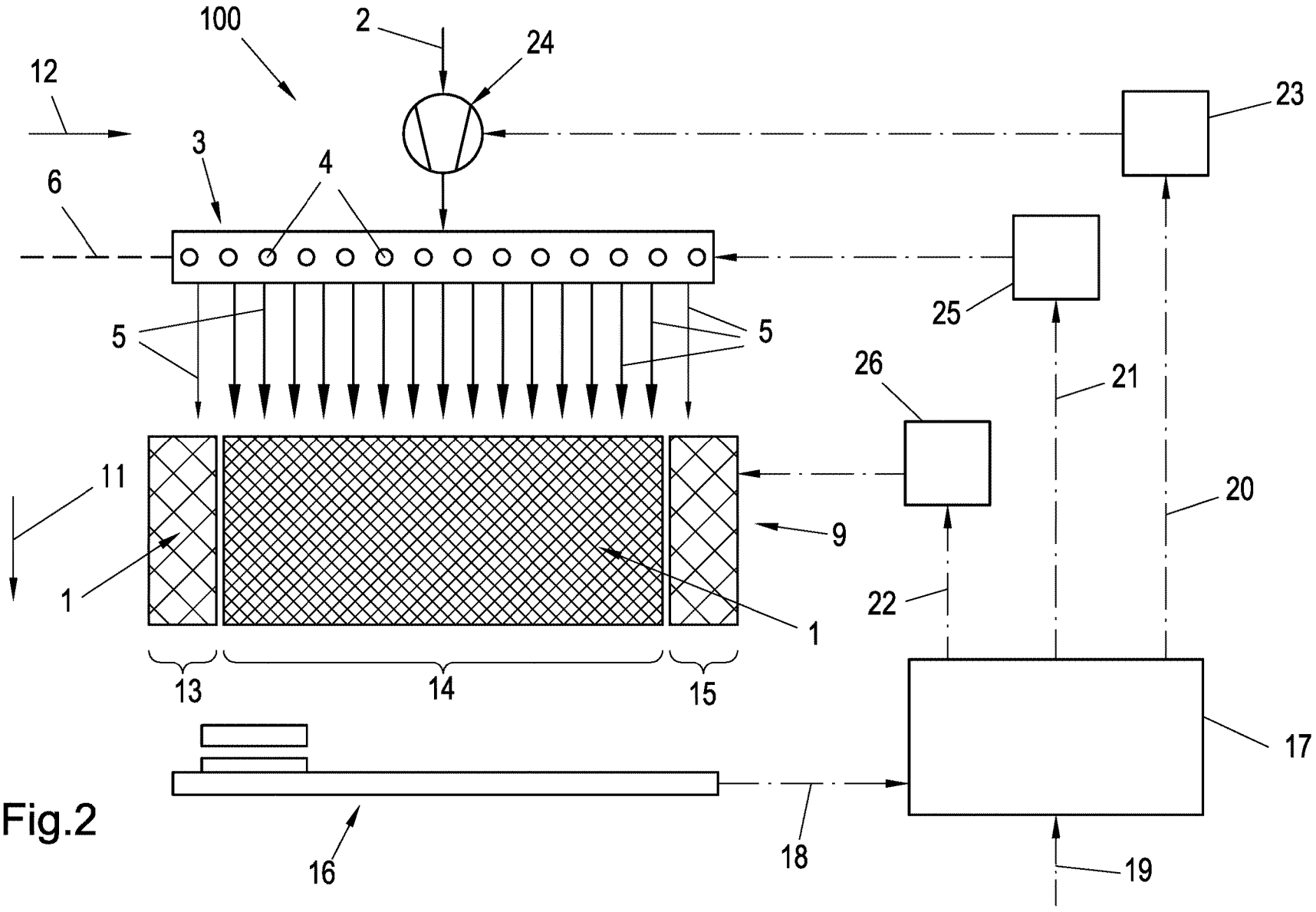
FIG. 2 shows a schematic illustration of the regulation according to the invention of the basis weight distribution in the process according to FIG. 1.

As a result of the spinning mass throughput of the spinneret 3, which is variable in the transverse direction 12, a spunbonded nonwoven 1 with a basis weight variable in the transverse direction 12, i.e., a basis weight distribution in the transverse direction 12, is obtained on the conveyor belt 10, which is illustrated in further detail in FIG. 2. In this context, the spunbonded nonwoven has several areas 13, 14, 15 with different basis weights, with the edge cut areas 13, 15 having a lower basis weight than the useful area 14. In this case, the basis weight of the edge cut areas 13, 15 is less than 5 g/m2 and is reduced by at least 90% in comparison to the useful area 14.

In order to reliably control the spinning mass throughput of the spinneret 3 in the transverse direction 12 and thus the basis weight distribution of the spunbonded nonwoven 1 or, respectively, in order to obtain a spunbonded nonwoven 1 with a defined target basis weight distribution 19, the actual basis weight distribution 18 of the spunbonded nonwoven 1 is measured by means of a detection device 16 and transmitted to a control unit 17 connected to the detection device 16. The control unit 17 then determines a difference between the measured actual basis weight distribution 18 and the target basis weight distribution 19, wherein control signals 20, 21, 22 are output on the basis of the difference.

In FIG. 2, the regulation of the actual basis weight distribution 18 by means of the control unit 17 and control signals 20, 21, 22 are depicted in detail. In this case, the control signal 20 serves for regulating the pressure distribution of the spinning mass 2 in the spinneret 3. To this end, the control signal 20 is output to a spinning mass control device 23, which controls the spinning mass pumps 24 allocated to the spinneret 3 in order to control the pressure distribution of the spinning mass 2 and thus to adjust the spinning mass throughput of the spinneret 3. The control signal 21 in turn serves for regulating the temperature distribution of the spinneret 3 and, for this purpose, is output to a spinneret control device 25, which changes the temperature of the spinneret 3 in the transverse direction 12 in such a way that the spinning mass throughput of the spinneret 3 is adjusted in the transverse direction 12. Finally, the control signal 22 is output to a conveyor belt control device 26 for regulating the conveying speed of the conveyor belt 10 and, thus, for adjusting the basis weight of the spunbonded nonwoven 1.

Figure 3:
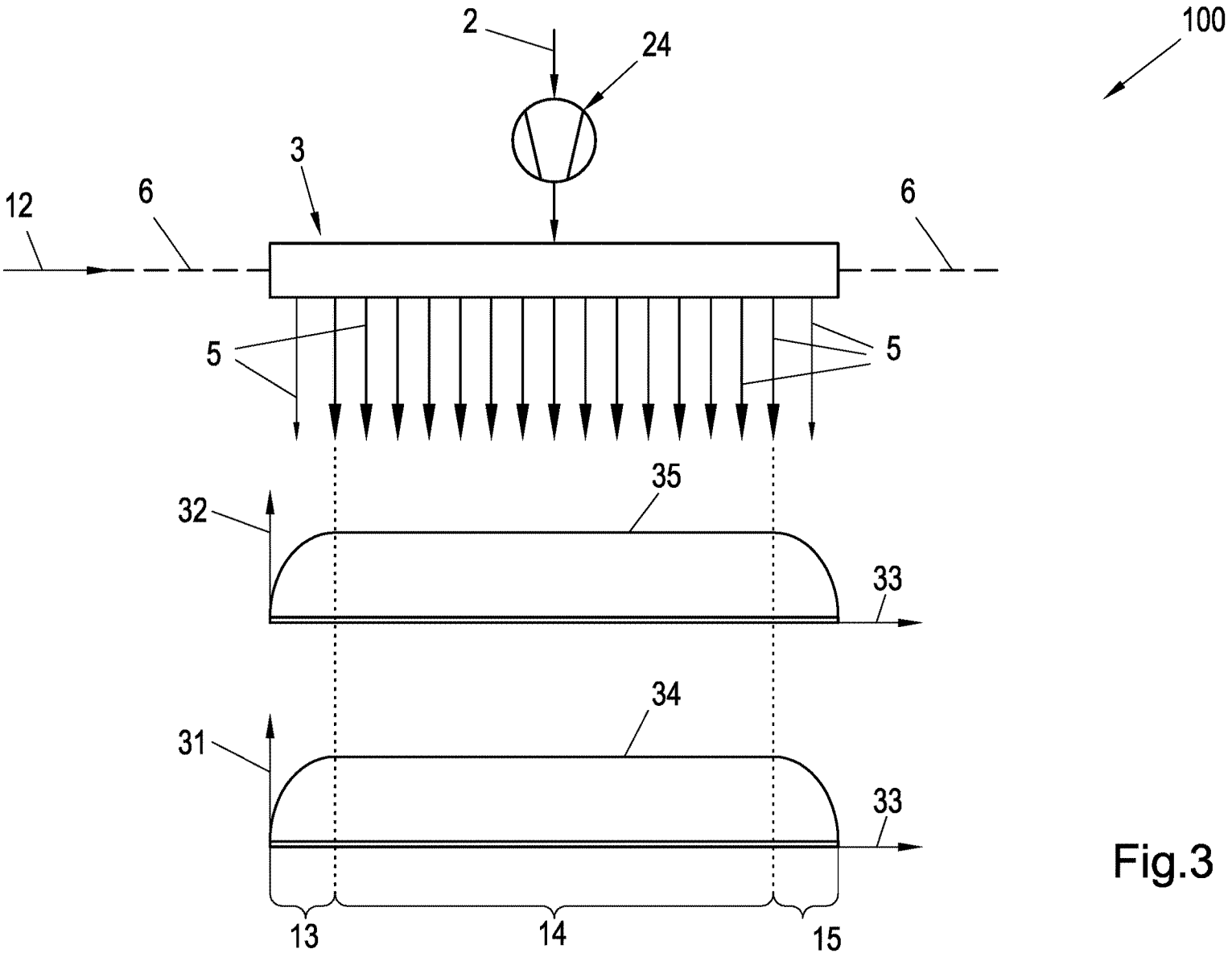
FIG. 3 shows a schematic illustration of the local distribution of the spinning mass throughput as a function of the temperature profile according to the first embodiment variant.

In FIG. 3, the local spinning mass throughput distribution 34 and the temperature distribution 35 in the spinneret 3 are illustrated, wherein the spinning mass throughput distribution 34 and the temperature distribution 35 each represent the course of the spinning mass throughput 31 and, respectively, of the temperature 32 as a function of the expansion 33 of the spinneret 3 in the transverse direction 12. In this case, the temperature distribution 35 exhibits a drop in temperature 32 towards the edges in the corresponding edge cut areas 13, 15, as depicted on the spunbonded nonwoven 1 in FIG. 2, while the temperature 32 in the useful area 14 is kept essentially constant. Following the temperature distribution 34, a lower spinning mass throughput 31 will also appear in the edge cut areas 13, 15, which is then reflected in the lower basis weight in the edge cut areas 13, 15—as shown in FIG. 2.

As is also evident from FIG. 2, a feedback loop is provided between the control devices 23, 25, 26 and the detection device 16, which is able to achieve and keep constant a target basis weight distribution 19 in the finished spunbonded nonwoven 1 in a fully automatic fashion, by controlling the spinning mass throughput of the spinneret 3 and the conveying speed of the conveyor belt 10. Keeping the basis weight distribution constant in this way may serve both for levelling out fluctuations in the cellulose raw material and for producing a spunbonded nonwoven 1 with a predefined basis weight profile.

As illustrated in FIG. 1, after the spunbonded nonwoven 1 has been formed, it is finally subjected to washing 27 and hydroentanglement 28. In a following step, the washed and hydroentangled spunbonded nonwoven 1 is then subjected to drying in a dryer 29 in order to remove the remaining moisture and to obtain a finished spunbonded nonwoven 1. Finally, the process 100 is concluded by optionally winding 30 and/or packaging the finished spunbonded nonwoven 1.

In this case, the detection device 16 for measuring the actual basis weight distribution 18 of the spunbonded nonwoven 1 is advantageously provided between the dryer 29 and the winding 30, since, following the dryer 29, the properties of the finished spunbonded nonwoven 1 can be determined, whereby a high reliability of the process 100 is achieved.

In a further embodiment, which is not illustrated in further detail in the figures, the spunbonded nonwoven 1 is trimmed around the edge cut areas 13, 15 prior to winding 30 so that only the useful area 14 is supplied to winding 30.

Figure 4:
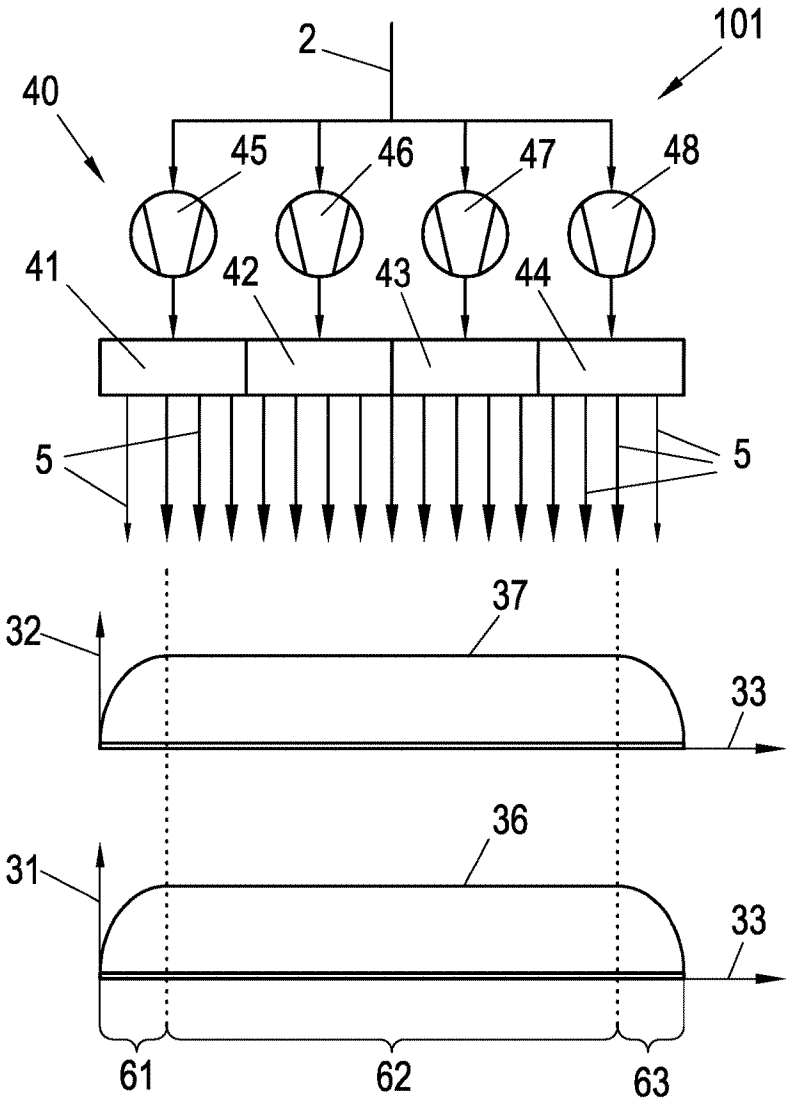
FIG. 4 shows a schematic illustration of the local distribution of the spinning mass throughput as a function of the temperature profile according to a second embodiment variant with modular spinnerets.

In FIG. 4, a multi-part spinneret 40 with several spinneret modules 41, 42, 43, 44 according to a further embodiment variant of the process 101 according to the invention is shown. In this case, one spinning mass pump 45, 46, 47, 48 is allocated to each spinneret module 41, 42, 43, 44 in order to adjust the pressure distribution in the spinneret 40 in addition to the temperature distribution 37. In the exemplary embodiment forming the subject-manner, the spinning mass pumps 45-48 each produce the same pressure in the spinneret modules 41-44 and thus ensure a uniform pressure distribution in the spinneret 40. As shown in FIG. 4, the spinning mass throughput distribution 36 also exhibits, in each case, one drop in the edge areas so that edge cut areas 61, 63 are again formed on the spunbonded nonwoven 1, in which the basis weight is reduced in comparison to the useful area 62.

Figure 5:
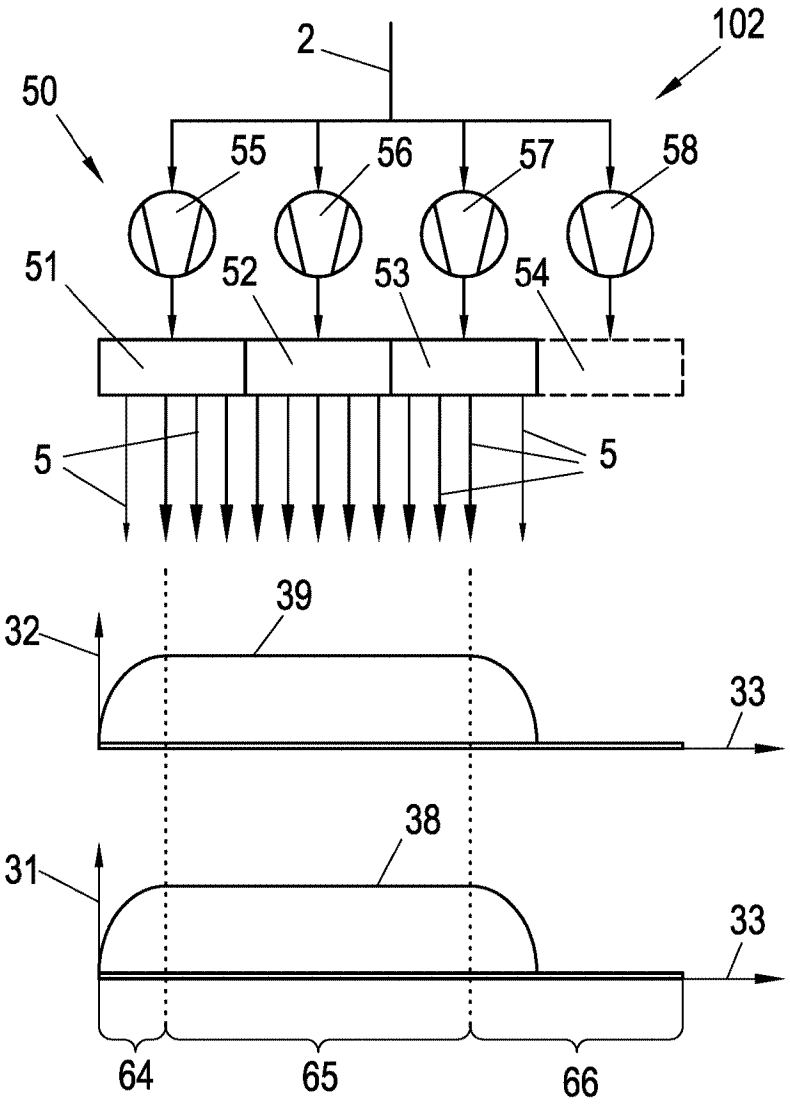
FIG. 5 shows a schematic illustration of the local distribution of the spinning mass throughput as a function of the temperature profile according to a third embodiment variant with modular spinnerets.

In FIG. 5, a further multi-part spinneret 50 with four spinneret modules 51, 52, 53, 54 according to a further embodiment variant of the process 102 according to the invention is shown. As already illustrated for FIG. 4, a spinning mass pump 55, 56, 57, 58 is again allocated to each spinneret module 51, 52, 53, 54. In contrast to FIG. 4, in the embodiment variant forming the subject-manner, the spinning mass pump 58 delivers spinning mass 2 at only a low or, respectively, minimal pressure, and, hence, the pressure distribution in the spinneret 50 exhibits a very low pressure in the area of the spinneret module 54, whereby the spinneret 50 also produces only a minimal spinning mass throughput 31 in the area of the spinneret module 54. In addition, a temperature distribution 39 is again provided in the spinneret 50, which is reflected in a spinning mass throughput distribution 38, which, in turn, leads to edge cut areas 64, 66 in the spunbonded nonwoven 1 with a lower basis weight than in the useful area 65. In the exemplary embodiment forming the subject-matter, the edge cut area 66 is now composed of the drop in basis weight due to the temperature distribution 39 and the uneven pressure distribution, whereby an extended edge cut area 66 with a very low basis weight is created in the spunbonded nonwoven 1. The waste after the trimming of the spunbonded nonwoven 1 to the useful area 65 can thus be kept to a minimum.

In a further embodiment variant, the wastes from the edge cut areas 14, 16, 61, 63, 64, 66 can be reused as a cellulosic raw material for the production of spinning mass 2, which, however, has not been illustrated in further detail in the figures.

What is claimed is:

1. A process for producing a spunbonded nonwoven comprising:

extruding a spinning mass through a plurality of nozzle holes of at least one spinneret to form filaments, and drawing the filaments, in each case, in an extrusion direction, wherein the filaments are deposited on a perforated conveying device to form the spunbonded nonwoven, wherein the plurality of nozzle holes of the at least one spinneret are arranged along a main axis oriented in a transverse direction to a conveying direction of the perforated conveying device so that the spunbonded nonwoven formed on the perforated conveying device extends in the transverse direction, wherein a spinning mass throughput of the plurality of nozzle holes is adjusted variably along the transverse direction, and wherein the spunbonded nonwoven has at least one edge cut area of a lower basis weight.

2. The process according to claim 1, further comprising:

changing temperature distribution in the at least one spinneret to control the spinning mass throughput of the plurality of nozzle holes variable in the transverse direction; and/or changing pressure distribution of the spinning mass in the at least one spinneret to control the spinning mass throughput of the plurality of nozzle holes variable in the transverse direction.

3. The process according to claim 2, wherein a plurality of spinning mass pumps is allocated to the at least one spinneret along the transverse direction for adjusting pressure of the spinning mass in the at least one spinneret.

4. The process according to claim 3, wherein the at least one spinneret is designed in multiple parts in the transverse direction, with at least one of the plurality of spinning mass pumps being allocated to each part of the at least one spinneret.

5. The process according to claim 1, wherein a basis weight of the spunbonded nonwoven in the at least one edge cut area is less than or equal to 5 $g/m^2$.

6. The process according to claim 1, wherein after forming, the spunbonded nonwoven is trimmed from the at least one edge cut area.

7. The process according to claim 1, further comprising:

measuring an actual basis weight distribution of the spunbonded nonwoven, determining a difference between the actual basis weight distribution and a predefined target basis weight distribution, and variably adjusting the spinning mass throughput of the plurality of nozzle holes in the transverse direction as a function of the difference that is determined.

8. The process according to claim 7, wherein a conveying speed of the perforated conveying device is adjusted as a function of the difference between the actual basis weight distribution and the predefined target basis weight distribution.

9. The process according to claim 7, wherein the actual basis weight distribution of the spunbonded nonwoven is measured by means of a detection device.

10. The process according to claim 9, wherein, by means of a control unit connected to the detection device, the difference between the actual basis weight distribution measured by the detection device and the predefined target basis weight distribution stored in the control unit is determined.

11. The process according to claim 10, wherein, for changing the spinning mass throughput of the plurality of nozzle holes, the control unit outputs at least one control signal to a spinneret control device regulating a temperature distribution and/or at least one control signal to a spinning mass control device regulating a pressure distribution of the at least one spinneret, depending on the difference that is determined.

12. The process according to claim 10, wherein, depending on the difference that is determined, the control unit outputs at least one control signal for changing a conveying speed of the perforated conveying device to a conveyor belt control device.

13. The process according to claim 1, wherein the spunbonded nonwoven is a cellulosic spunbonded nonwoven and the spinning mass is a solution of cellulose in a direct solvent.

14. The process according to claim 13, wherein the direct solvent is a tertiary amine oxide in an aqueous solution.

15. A process for producing a spunbonded nonwoven comprising:

extruding a spinning mass through a plurality of nozzle holes of at least one spinneret to form filaments, drawing the filaments, in each case, in an extrusion direction, wherein the filaments are deposited on a perforated conveying device to form the spunbonded nonwoven, measuring an actual basis weight distribution of the spunbonded nonwoven, determining a difference between the actual basis weight distribution and a predefined target basis weight distribution, and variably adjusting the spinning mass throughput of the plurality of nozzle holes in a transverse direction as a function of the difference that is determined, wherein the plurality of nozzle holes of the at least one spinneret are arranged along a main axis oriented in the transverse direction to a conveying direction of the perforated conveying device so that the spunbonded nonwoven formed on the perforated conveying device extends in the transverse direction, wherein a spinning mass throughput of the plurality of nozzle holes is adjusted variably along the transverse direction, and wherein a conveying speed of the perforated conveying device is adjusted as a function of the difference between the actual basis weight distribution and the predefined target basis weight distribution.

16. The process according to claim 15, further comprising:

changing temperature distribution in the at least one spinneret to control the spinning mass throughput of the plurality of nozzle holes variable in the transverse direction; and/or changing pressure distribution of the spinning mass in the at least one spinneret to control the spinning mass throughput of the plurality of nozzle holes variable in the transverse direction.

17. The process according to claim 16, wherein a plurality of spinning mass pumps is allocated to the at least one spinneret along the transverse direction for adjusting pressure of the spinning mass in the at least one spinneret.

18. The process according to claim 17, wherein the at least one spinneret is designed in multiple parts in the transverse direction, with at least one of the plurality of spinning mass pumps being allocated to each part of the at least one spinneret.

19. The process according to claim 15, wherein the spunbonded nonwoven has at least one edge cut area of a lower basis weight, and wherein a basis weight of the spunbonded nonwoven in the at least one edge cut area is less than or equal to 5 $g/m^2$.

20. The process according to claim 15, wherein the spunbonded nonwoven has at least one edge cut area of a lower basis weight, and wherein after forming, the spunbonded nonwoven is trimmed from the at least one edge cut area.

21. The process according to claim 15, wherein the actual basis weight distribution of the spunbonded nonwoven is measured by means of a detection device.

22. The process according to claim 21, wherein, by means of a control unit connected to the detection device, the difference between the actual basis weight distribution measured by the detection device and the predefined target basis weight distribution stored in the control unit is determined.

23. The process according to claim 22, wherein, for changing the spinning mass throughput of the plurality of nozzle holes, the control unit outputs at least one control signal to a spinneret control device regulating a temperature distribution and/or at least one control signal to a spinning mass control device regulating a pressure distribution of the at least one spinneret, depending on the difference that is determined.

24. The process according to claim 22, wherein, depending on the difference that is determined, the control unit outputs at least one control signal for changing a conveying speed of the perforated conveying device to a conveyor belt control device.

25. The process according to claim 15, wherein the spunbonded nonwoven is a cellulosic spunbonded nonwoven and the spinning mass is a solution of cellulose in a direct solvent.

26. The process according to claim 25, wherein the direct solvent is a tertiary amine oxide in an aqueous solution.

* * * * *